US005906007A

United States Patent [19]

Roberts

[11] Patent Number: 5,906,007

[45] Date of Patent: May 25, 1999

[54] ARTICLE OF FOOTWEAR FOR USE IN RELATION TO A PEDICURE

[76] Inventor: Liana Callas Roberts, 5219 S. Kellen Ct., Bloomfield Hills, Mich. 48302

[21] Appl. No.: 09/113,278

[22] Filed: Jul. 10, 1998

[51] Int. Cl.[6] ..... A41B 11/00

[52] U.S. Cl. ..... 2/239; 2/269; 132/73

[58] Field of Search ..... 2/239, 61, 269, 2/270, 22, 83, 241, 242, 409; 36/94, 95, 102, 9 R; 132/73, 285; 66/178 R, 184, 185, 186, 187

[56] References Cited

U.S. PATENT DOCUMENTS

| | | | |
|---|---|---|---|
| D. 143,938 | 2/1946 | Schapiro . | |
| D. 172,916 | 8/1954 | Ballinger et al. . | |
| D. 271,156 | 11/1983 | Williamson | D2/270 |
| D. 381,465 | 7/1997 | Estell | D28/56 |
| 482,095 | 9/1892 | McClurg | 2/239 |
| 715,543 | 12/1902 | Bosworth | 2/239 |
| 1,098,397 | 6/1914 | Pecorella . | |
| 1,798,201 | 3/1931 | Hedges | 2/239 |
| 2,751,693 | 6/1956 | Baker | 36/8.5 |
| 3,049,120 | 8/1962 | Marcus . | |
| 3,329,972 | 7/1967 | Schwab et al. | 2/239 |
| 4,149,274 | 4/1979 | Garrou et al. | 2/239 |
| 4,181,982 | 1/1980 | Segovia | 2/83 |
| 4,207,880 | 6/1980 | Zinkovich . | |
| 4,475,253 | 10/1984 | Laveckis | 2/269 |
| 5,054,129 | 10/1991 | Baehr | 2/239 |
| 5,067,179 | 11/1991 | Wormser | 2/239 |
| 5,623,734 | 4/1997 | Pugliatti | 2/239 |

*Primary Examiner*—Amy B. Vanatta
*Attorney, Agent, or Firm*—Harness, Dickey & Pierce, P.L.C.

[57] ABSTRACT

An article of footwear for use during and following the application of a pedicure. The article includes a body consisting of a leg portion, an ankle portion, and a foot portion. At the toe end of the foot portion are defined a plurality of apertures. Fitted to the approximate peripheries of the apertures and extending therefrom are a like plurality of open-ended toe sheaths. The sheaths may be selectively extended or retracted through unrolling or rolling as desired.

20 Claims, 2 Drawing Sheets

ARTICLE OF FOOTWEAR FOR USE IN RELATION TO A PEDICURE

BACKGROUND OF THE INVENTION

1. Field of the Invention

The present invention relates to an article for use following a pedicure. More particularly, the present invention provides footwear having a plurality of individual, open-ended sheaths capable of being moved from a toe-covering position to a toe-exposing position before, during, and after a pedicure.

2. Description of the Prior Art

The pedicure is regarded by some women as a luxury and by others as a necessity. During this treatment, the whole foot is generally treated through (1) the application of creams, hot wax, lotions, or other skin-conditioning softeners, (2) foot manipulation including rubbing, and/or (3) the manicuring and painting of toenails with a nail polish. Regardless of the opinion held for the level of necessity for the pedicure, it is held by all women who receive toenail polish during their pedicures that it is important to keep any material from contacting the freshly coated nail until the polish sets substantially to a hard finish. This may take a number of hours. It is also desirable to keep the toes separated during the drying process. However, it is not always practical to not wear something on the feet and toes, and to keep the toes separated women frequently place rolled up tissue between their toes or use toe-separating sandals having rigid or semi-rigid toe separators. However, the difficulty arises in that professional pedicures are administered in salons and not in the home where going barefoot might be an option. While it is possible for the woman receiving the pedicure to wear sandals, for example, this option is not always desirable in cold or wet weather, as the remainder of the foot remains uncovered. Today, the choice for a woman receiving a pedicure at a salon is to leave the shop barefooted (an unacceptable option), wear sandals with the toes exposed (impractical or impossible in cold weather), or to wear normal shoes (thus running the risk of damaging unset paint).

Efforts have been expended in the past to respond to the need for modified footwear for use in relation to pedicures. For example, in U.S. Design Pat. No. 271,156, issued on Nov. 1, 1983, to Williamson for "Pedicure Sandal." An additional example may be found in U.S. Design Pat. No. 381,465, issued on Jul. 22, 1997, to Estell for "Pedicure Aid for Wearing on a Foot and Separating Toes."

In U.S. Pat. No. 2,751,693, issued on Jun. 26, 1956, to Baker for "Toe Spacing Sandal," a sandal is disclosed for separating the toes of a human foot for a variety of purposes, including the application of nail polish.

In U.S. Pat. No. 4,207,880, issued on Jun. 17, 1980, to Zinkovich for "Combination Corrective Toe Separator Apparatus and Pedicure Aid," an article of footwear is provided to keep toes separated during pedicures.

While perhaps providing incremental responses to the need for footwear in relation to pedicures, the prior art has failed to provide a satisfactory resolution of the problem. Accordingly, an answer to the problem of providing appropriate footwear for use in relation to the application of a pedicure remains wanting.

BRIEF SUMMARY OF THE INVENTION

It is the general object of the present invention to provide footwear which overcomes the problems of known articles.

It is a specific object of the present invention to provide an article of footwear which includes individual sheaths for each toe of the wearer's foot.

A further object of the present invention is to provide such an article in which the individual toe sheaths can be retracted through folding to expose the wearer's toenails, thereby making them accessible to pedicuring and for air exposure thereafter until dried or substantially dried.

An additional object of the present invention is to provide such an article which is lightweight.

Yet an additional object of the present invention is to provide such an article which is easy to clean.

Still a further advantage of the present invention is to provide such an article which may optionally include a plurality of grips fitted to the underside of the article.

An additional object of the present invention is to provide such an article which may be worn by a woman out of the salon after receiving a pedicure with a shoe or a sandal.

To accomplish these and other objects an article of footwear is provided that includes a body which is defined by a leg portion, an ankle portion, and a foot portion. A series of apertures are formed in the toe end of the foot portion. Attached to the peripheries of the apertures are a like number of toe sheaths or tubes. Preferably, the body and sheaths are made of a knitted or woven natural or synthetic material, such as polyester. Most preferably the body and sheaths are made of cotton with a lycra component. The body and sheaths may be of the same or different colors. The leg portion may be long, such as knee-high, or may be short, such as just above the ankle. Optionally, one or more grips could be applied to the underside of the foot portion of the body.

The article of footwear of the present invention allows the user to selectively extend or retract the toe sheaths through unrolling or rolling as was necessary. The article could then be worn before, during, and after a pedicure.

BRIEF DESCRIPTION OF THE DRAWINGS

The present invention will be more fully understood by reference to the following detailed description of the preferred embodiments of the present invention when read in conjunction with the accompanying drawings, in which like reference characters refer to like parts throughout the views, and in which.

DETAILED DESCRIPTION OF THE PREFERRED EMBODIMENTS OF THE PRESENT INVENTION

The drawings disclose the preferred embodiments of the present invention. While the configurations according to the illustrated embodiments are preferred, it is envisioned that alternate configurations of the present invention may be adopted without deviating from the invention as portrayed. The preferred embodiments are described hereafter.

Figure 1:
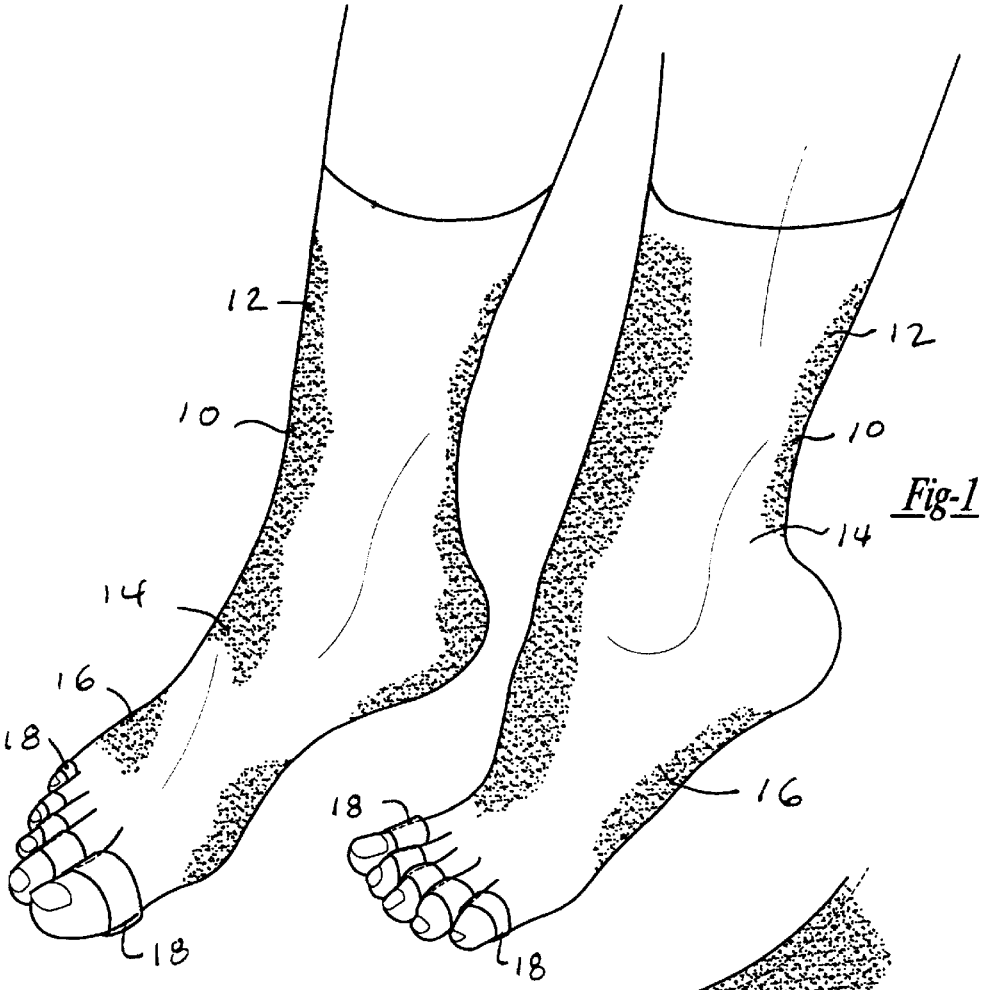
FIG. 1 is a perspective view of a pair of feet with each foot being fitted with the footwear article of the present invention.

Referring to FIG. 1, a perspective view of a pair of feet each fitted with an article of footwear according to the present invention is shown. The article for each foot is substantially identical except for the reverse order of toes from small to large selecting between right and left feet. The article of footwear is generally illustrated as 10.

The article 10 includes a leg portion 12, an ankle portion 14, and a foot portion 16. The leg portion 12 may be of the height illustrated as shown in FIG. 1, or may be higher or lower as preferred. For example, the height of the leg portion 12 may be such that the wearer's calf is covered. The leg portion 12 may be higher than the calf.

The foot portion 16 has defined at its toe end a plurality of toe-passing apertures, each aperture terminating at a toe sheath 18, of which there are five per article 10. The toe sheath 18 is continuous with the foot portion 16. The toe sheath 16 may be manufactured in a continuous process as part of the foot portion 16 or may be manufactured separately from the foot portion 16 and connected to the foot portion 16 afterward. Accordingly, the toe sheaths 18 may be the same or different colors from the leg portion 12, the ankle portion 14, and the foot portion 16. It is also possible to make the toe sheaths 18 from a material that is different from that of the rest of the article, as may be desired for warmth, support, or to improve the wear-resistance of the toe sheaths 18.

Figure 2:
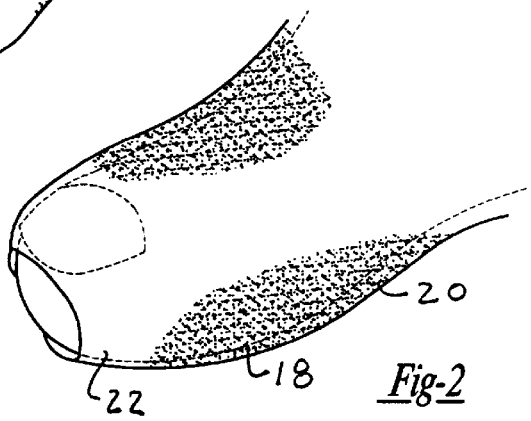
FIG. 2 is a perspective view of a single toe of one of the feet of FIG. 1 showing the toe-covering sheath in its extended position.

FIG. 2 illustrates a perspective of a single toe being substantially covered by an unfolded toe sheath 18. The sheath 18 includes a body portion 20 and a tip portion 22. As is illustrated, the tip portion 22 substantially but not necessarily entirely covers the toe. (The tip portion 22 may also extend beyond the end of the toe such that none of the toe is revealed.) It is in this unfolded position that the wearer would use the article 10 prior to receiving the pedicure or subsequent to the substantially complete drying of the nail polish. When the tip portion 22 is in its unfolded state as illustrated, the article of footwear 10 may be used in any manner in which, for example, a stocking might be worn, such as with a shoe or with a sandal (not illustrated).

Figure 3:
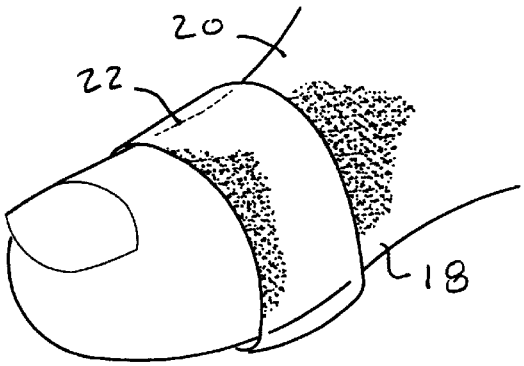
FIG. 3 is a view similar to that of FIG. 2 except showing the toe sheath in its folded-back position.
Figure 4:
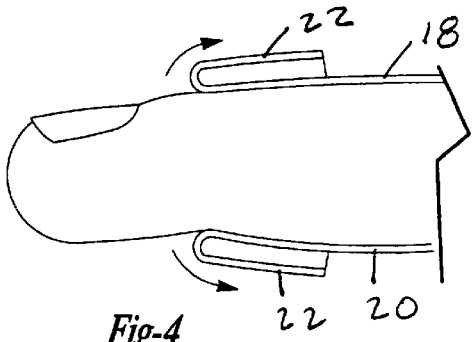
FIG. 4 is a side view of a single toe showing the folded-back toe sheath of FIG. 3 in partial cross-section.

To make the toe accessible for manicuring and polishing, the wearer simply folds or rolls the tip portion 22 of the sheath 18 back toward the portion 16 of the article 10 as illustrated in FIGS. 3 and 4. In this position, the tip portion 22 is folded back onto the body portion 20 of the toe sheath 18. As is illustrated, the toenail is fully exposed for manicuring and polishing. This position also allows the rolled-up sheath 18 to separate the toes as may be desired. After the polish has sufficiently dried, the tip portion 22 is unfolded back to its extended position as shown in FIG. 2 and the article 10 may thus be worn until such time as the user elects to remove it in favor of more conventional footwear.

Figure 5:
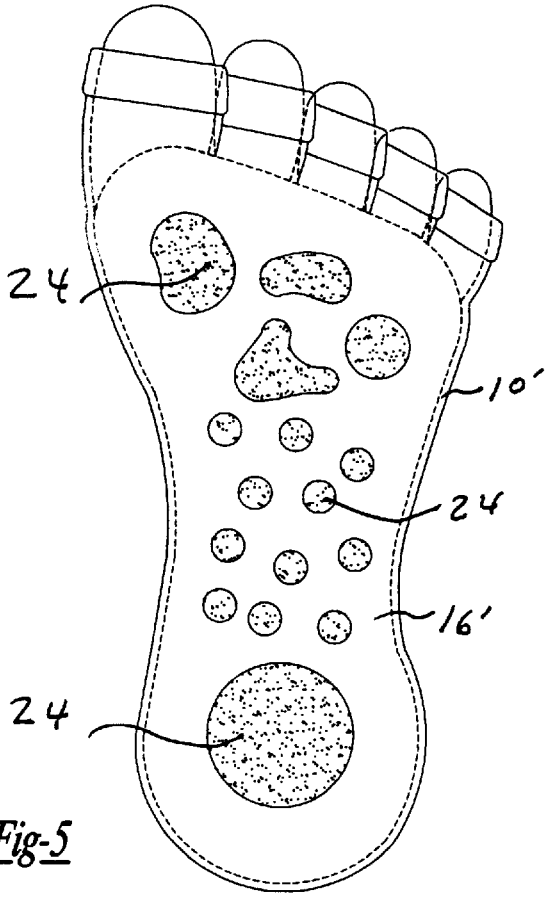
FIG. 5 is are underside view of the article of footwear according to the present invention illustrating a first preferred embodiment of the optimal gripping surfaces.

It is possible that variations of the present invention may be prepared. For example, and as shown in FIG. 5, the underside of a foot portion 16' of an article of footwear 10' may be fitted with a plurality of grips 24. The grips 24 may be composed of a polymerized material of a composition and a consistency so as to provide the user with some gripping function upon use with a smooth surface.

Figure 6:
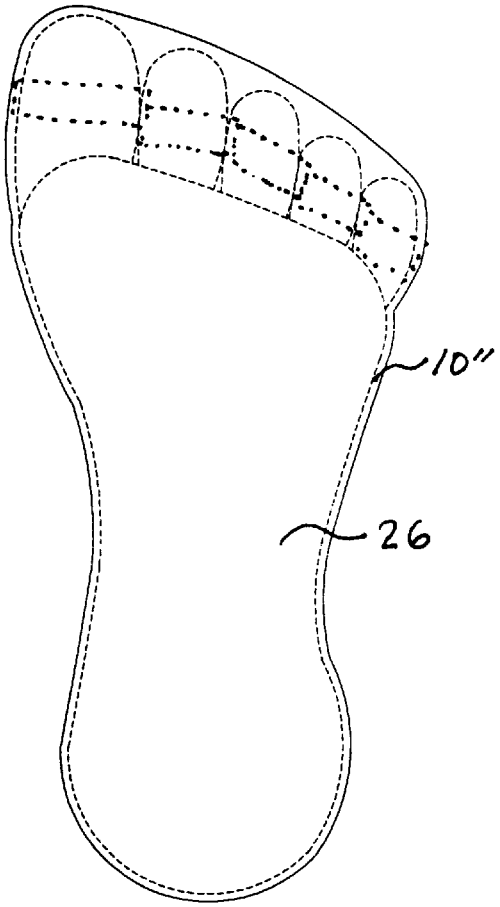
FIG. 6 is an underside view of the article of footwear according to the present invention similar to that of FIG. 5 but showing an alternate embodiment of the gripping surface.

FIG. 6 illustrates an additional embodiment of the present invention and shows the underside of an article of footwear 10". According to this embodiment, the article 10" is fitted with a sole portion 26 which substantially covers both the underside of the body of the cloth portion of the article 10" as well as the underside of the wearer's toes. The sole portion 26 may be formed from a variety of materials including leather or moleskin. The toe sheaths would not be connected to the sole portion 26. According to this embodiment, the article 10" provides many of the advantages available in such footwear as a sandal or beach thong. According to the embodiment of FIG. 6, the sole portion 26 is fitted to the body only of the cloth portion and not to the toe sheaths, thus allowing the user to selectively fold and unfold the sheaths as described above with respect to FIGS. 1 through 4 while still experiencing the advantages of having total protection to the underside of the foot.

The article 10 may be composed from a variety of both natural and synthetic materials. Of particular interest in such application is the cotton material known as Supplex® (trademark; DuPont [UK] Ltd.). However, this material is being suggested for purposes of example only, and is not intended as being limiting.

From the preceding description of the preferred embodiments, it is evident that the objects of the invention are attained. Although the invention has been described and illustrated in detail, it is to be clearly understood that the same is intended by way of illustration and example only and is not to be taken by way of limitation. The spirit and scope of the invention are to be limited only by the terms of the appended claims.

What is claimed is:

1. An article of footwear for use in relation to the polishing of a human toe as part of a pedicure, the article comprising:

a body, said body including a leg portion, an ankle portion, and a foot portion;

a plurality of flexible toe sheaths fitted to said foot portion of said body, each of said sheaths including a body portion and a tip portion, said tip portion being movable between an extended unfolded position and a folded position, whereby the toe is substantially covered by said sheath when said sheath is in said extended unfolded position.

2. The article of footwear of claim 1, wherein said body and said sheaths are composed of a stretchable material.

3. The article of footwear of claim 1, wherein said body is composed of a first material and said sheaths are composed of a second material, said first and second materials being different.

4. The article of footwear of claim 1, wherein said sheath is formed from sufficient material so as to substantially cover the toe when said sheath is in said extended position.

5. The article of footwear of claim 1, wherein said tip portion is positioned adjacent said body portion when said tip portion is folded thereover.

6. The article of footwear of claim 1, wherein said foot portion includes an underside and wherein said underside is fitted with means for gripping.

7. The article of footwear of claim 6, wherein said means for gripping is defined by a plurality of grips fitted to said underside of said foot portion.

8. The article of footwear of claim 6, wherein said means for gripping is a sole portion which substantially covers said underside of said foot portion.

9. The article of footwear of claim 8, wherein said sole portion further substantially covers said sheaths.

10. An article of footwear for selectively at least partially covering the wearer's toe, the article comprising:

an elastic body having a toe end and a plurality of apertures defined in said toe end, each of said apertures defined by a peripheral surface;

a plurality of elastic toe sheaths equivalent in number to said plurality of apertures, said plurality of toe sheaths attached to said peripheral surfaces defining said plurality of apertures such that one sheath is attached to one peripheral surface, each of said sheaths including a portion capable of being folded substantially back onto itself such that each of said sheaths is selectively movable between a folded position and an unfolded position, whereby each of said sheaths is folded substantially back onto itself to expose the wearer's toe nail.

11. The article of footwear according to claim 10, wherein said elastic body includes a leg portion, an ankle portion, and a foot portion.

12. The article of footwear according to claim 10, wherein said elastic body is composed of a first material and said sheaths are composed of a second material, said first and second materials being different.

13. The article of footwear according to claim 10, wherein said sheaths are formed of sufficient material so as to substantially cover the toe when said sheath is in said unfolded position.

14. The article of footwear according to claim 10, wherein each of said sheaths includes a tip portion.

15. The article of footwear according to claim 11, wherein said foot portion includes an underside and wherein said underside is fitted with means for gripping.

16. The article of footwear according to claim 15, wherein said means for gripping is defined by a plurality of grips fitted to said underside of said foot portion.

17. The article of footwear according to claim 15, wherein said means for gripping is a sole portion which substantially covers said underside of said foot portion.

18. The article of footwear of claim 17, wherein said sole portion further substantially covers said sheaths.

19. An article of footwear for selectively exposing the toe nails of a wearer, the article comprising:

a body;

a plurality of toe-covering sheaths attached to said body, said sheaths being composed of an elastic material, each of said sheaths including a body portion and a covering portion, said body portion of each of said sheaths being continuous with said body of the article of footwear, at least a portion of said covering portion being movable between an extended unfolded position and a folded position, whereby the toe is substantially covered by said sheath when said sheath is in said extended unfolded position.

20. The article of footwear according to claim 19, wherein said body includes an underside, said underside of said body being fitted with a gripping material.

* * * * *